US006677010B1

(12) United States Patent
Schneider et al.

(10) Patent No.: US 6,677,010 B1
(45) Date of Patent: Jan. 13, 2004

(54) THERMAL TRANSFER SHEET FOR THE LASER-INDUCED COATING OF A PRINTING FORM CYLINDER

(75) Inventors: Josef Schneider, Diedorf (DE); Thomas Hartmann, Neusäss (DE); Andrea Fuchs, Augsburg (DE); Hans-Christoph Beltle, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 71 days.

(21) Appl. No.: 09/631,483

(22) Filed: Aug. 3, 2000

(30) Foreign Application Priority Data

Aug. 7, 1999 (DE) ..... 199 37 478

(51) Int. Cl.[7] ..... B41M 5/40
(52) U.S. Cl. ..... 428/32.63
(58) Field of Search ..... 428/32.63

(56) References Cited

U.S. PATENT DOCUMENTS

| | | | | |
|---|---|---|---|---|
| 5,382,964 A | | 1/1995 | Schneider | 346/76 PH |
| 5,663,755 A | * | 9/1997 | Wada et al. | 347/176 |
| 5,756,689 A | * | 5/1998 | Busman et al. | 534/560 |

FOREIGN PATENT DOCUMENTS

| | | | |
|---|---|---|---|
| DE | 39 41 303 | 12/1990 | |
| EP | 0 587 282 | 3/1984 | |
| EP | 0 432 506 | 6/1991 | |
| EP | 587 282 | 3/1994 | |
| EP | 698 488 | 8/1995 | B41C/1/10 |
| EP | 0 689 940 | 1/1996 | |
| EP | 727 321 | 8/1996 | |
| EP | 0 753 415 | 1/1997 | |
| EP | 787 777 | 8/1997 | |

OTHER PUBLICATIONS

Patent Abstracts of Japan, Publication No. 11–198532, Jul. 1999.
Patent Abstracts of Japan, Publication No. 11–212256, Aug. 1999.
Patent Abstracts of Japan, Publication No. 10–052977, Feb. 1998.
Patent Abstracts of Japan, Publication No. 11–170693, Jun. 1999.
Patent Abstracts of Japan, Publication No. 05–064981, Mar. 1993.
Patent Abstracts of Japan, Publication No. 08–072413, Mar. 1996.
Patent Abstracts of Japan, Publication No. 04–099694, Mar. 1992.
Patent Abstracts of Japan, Publication No. 09–226244, Sep. 1997.
Patent Abstracts of Japan, Publication No. 05–032058, Feb. 1993.
Patent Abstracts of Japan, Publication No. 11–321137, Nov. 1999.
Patent Abstracts of Japan, Publication No. 10–119436, May 1998.
Patent Abstracts of Japan, Publication No. 11–129619, May 1999.
Patent Abstracts of Japan, Publication No. 11–218964, Aug. 1999.
Patent Abstracts of Japan, Publication No. 11–181139, Jul. 1999.

* cited by examiner

*Primary Examiner*—B. Hamilton Hess
(74) *Attorney, Agent, or Firm*—Cohen, Pontani, Lieberman & Pavane

(57) ABSTRACT

A thermal transfer sheet suitable for preparing a lighographic printing form cylinder is provided including a substrate layer and a donor layer. The substrate layer includes a first polymer having mechanical stability at temperatures greater than 150 degrees C. and light transmission of at least 70% for wavelengths of from about 700 nm to about 1600 nm. The donor layer includes a second polymer having acidic groups and/or optionally substituted amide groups and an additive is capable of converting incident laser light energy into heat energy. A wetting aid and/or a solvent are also included in the donor layer. A method of making the thermal transfer sheet is also provided.

21 Claims, 1 Drawing Sheet

THERMAL TRANSFER SHEET FOR THE LASER-INDUCED COATING OF A PRINTING FORM CYLINDER

BACKGROUND OF THE INVENTION

1. Field of the Invention

The present invention relates to a thermal transfer sheet, which is suitable as a donor element for image-wise preparing a lithographic printing form cylinder. More particularly, the present invention is a thermal transfer sheet for laser induced transfer of an image to an offset-printing form cylinder having a substrate layer and a doner layer on the substrate layer.

The invention also relates to a method of making the thermal transfer sheet as well as to intermediate products therefor.

2. Description of the Related Art

A printing method is known wherein a printing form cylinder is provided with an image dot by dot using resin particles. This printing form cylinder is used in an offset-printing operation, during which it is coated with ink. The ink is then transferred to a rubber roll and is thereafter transferred from the rubber roll to the substrate, normally paper. In order to alter the printing motif in short time intervals, particularly if small issues are to be printed, it is desirable to carry out the operation using only one piece of machinery controlled by a computer. The printing device as described in-EP-B-0 698 488, to which U.S. Pat. No. 5,601, 222 corresponds, meets these requirements.

The printing form cylinder used in the above-mentioned printing device is coated with a polymer from a thermal transfer sheet dot by dot with an image. In order to obtain a printing plate being suitable for offset-printing, i.e. having a clear separation between hydrophilic (i.e. parts of the printing form cylinder not coated by the polymer) and hydrophobic (i.e. parts of the printing form cylinder coated by the polymer, which later during the printing operation absorb the printing ink) portions, certain physical and chemical parameters of the thermal transfer sheet, especially a thermal transfer ribbon, have to be optimized. It has been shown that common thermal transfer sheets do not or only partly fulfill these requirements.

SUMMARY OF THE INVENTION

The object of the present invention is to provide a thermal transfer sheet or ribbon suitable for preparing a printing form cylinder by laser-induced transfer of a polymer from a donor layer of the thermal transfer sheet or ribbon to the printing form cylinder. The thermal transfer sheet or ribbon must fulfill the following requirements: The support or substrate must fulfill mechanical requirements during transfer, optical requirements of the light transmission when irradiated with a laser beam and thermal requirements of heating of the coated layer. The coating on the metal should strongly adhere to the metal body and should have a uniform printing quality over a sufficient life-time. Finally removal of the coated polymer layer from the printing plate should be possible under mild and environmental-friendly conditions and in a short period of time to allow a new printing operation to be started.

Briefly stated, the present invention is a thermal transfer sheet having a substrate layer and a donor layer. The substrate layer includes a first polymer having mechanical stability at temperatures greater than 150 degrees C. and light transmission of at least 70% for wavelengths of from about 700 nm to about 1600 nm. The donor layer includes a second polymer having at least one of acidic groups and optionally substituted amide groups and an additive capable of converting incident laser light energy into heat energy.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

The thermal transfer sheet or ribbon of the present invention consists of a heat resistant substrate layer 1, (i.e. a support sheet or a support ribbon), upon which a donor layer 2 (i.e. a heat sensitive transferable layer) is applied. A laser beam 3 directed onto the back side of the thermal transfer ribbon (i.e. from the side of the substrate layer not being coated) induces a temperature rise in the heat sensitive layer, which in turn leads to a softening and an eventual dislocation of the resin particles. Gaseous substances are produced, especially at the interface 5 between the substrate layer 1 and the donor layer 2. Due to this process, even that portion of the donor layer which is the most remote from the substrate layer is dislocated from the donor layer in a soft, semi-solid state. The dislocated portion of the donor layer is projected onto the printing form cylinder. The resulting gases support the preferred direction of the resin particles towards the printing form cylinder.

Furthermore, the transfer process becomes irreversible by virtue of the manner of approach of the thermal transfer ribbon. Due to the high heat capacity of the body of the printing form cylinder, the resin cool down instantly and adheres to the printing form cylinder (e.g. metal). After the entire printing form cylinder has been provided spirally with a resin coating dot design at high speed, the transferred layer is then treated in two further steps. The first step is a fixation step. The fixation step enhances the adhesion of the resin material to the surface of the printing form. The second step is a hydrophilizing step. The exposed parts of the printing cylinder are made more hydrophilic throughout the entire surface (hydrophilization). At the same time, the profile of the transferred polymer is made sharper (boundary sharpness).

The term "hydrophilic", as used in the present application, means a preference for water as a measure of the wetability with water under dynamic conditions.

The printing form cylinder without any picture, has hydrophilic properties throughout the entire surface. In order to achieve this condition the following materials are suitable for preparing a printing form cylinder: e.g. plasma or flame treated ceramic and metal surfaces, respectively, such as chromium, brass (Cu 52–65% Zn 48–35%, e.g. Botomet L® Cu63Zn37), and special steels, in particular high alloy steel (according to DIN 17440: 1.43 xx (xx=01, 10, . . . . ), 1.4568, 1.44 xx (xx=04, 35, 01 . . . ).

Figure 1:
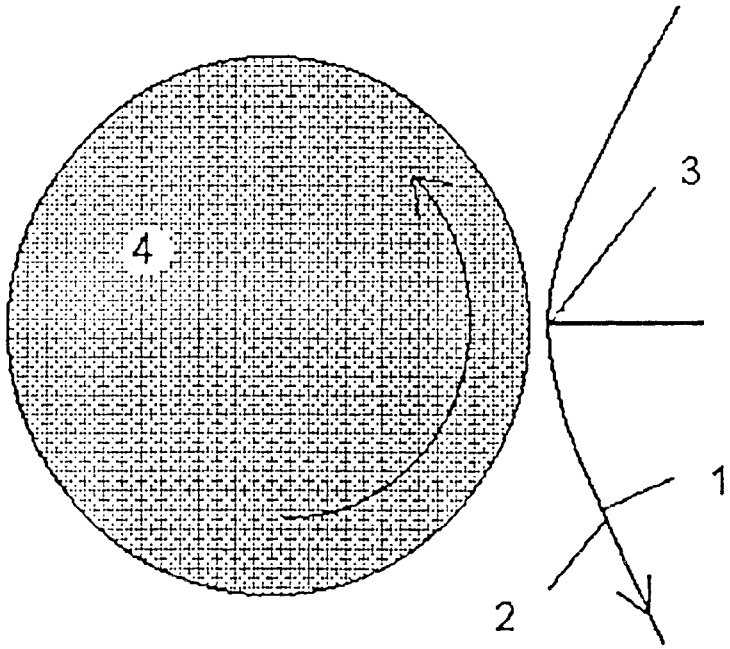
FIG. 1 is a schematic illustration of the printing process.

Referring now to FIG. 1, a laser beam 3 strikes the back of a substrate layer 1 of a thermal transfer ribbon (or a thermal transfer sheet) 1 and 2. The printing cylinder 4 rotates in the direction indicated. The printing cylinder 4 is provided spirally with the material of the donor layer 2 as an image.

Figure 2:
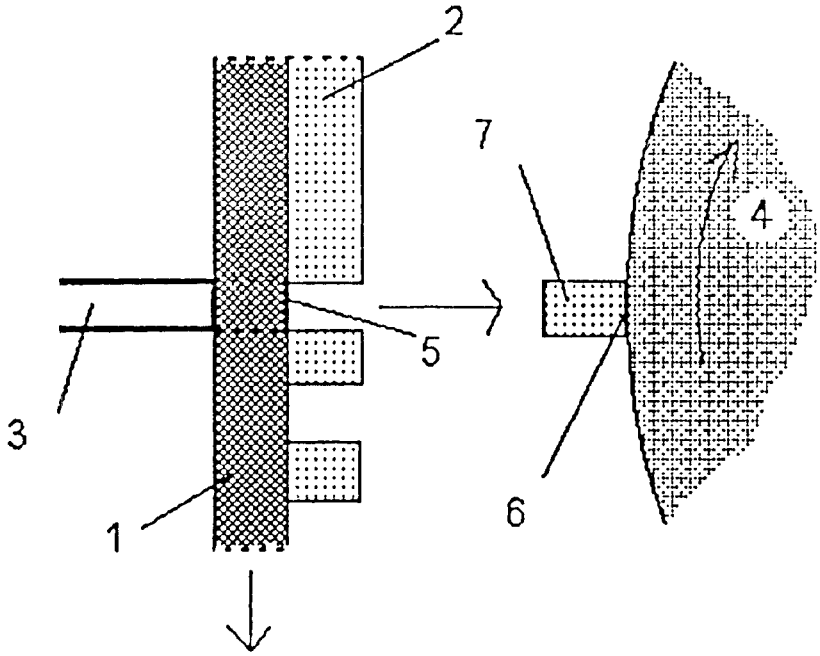
FIG. 2 is a schematic illustration of the transfer process.

Referring now to FIG. 2, polymeric particles 7 are dislocated from the donor layer by the effect of the laser beam 3 on the back of the thermal transfer ribbon (or thermal transfer sheet) 1 and 2 and the particles dislocated adhere to the printing form cylinder 4. The processes occurring at the boundary layer 5 and 6 respectively, are described below in greater detail.

The Substrate Layer

The substrate layer must be resistant to mechanical tension and local warming effects, for example, tension and warming that occurs while the substrate passes through the ribbon conveyor station. Moreover, the substrate layer must also be inert to chemicals used in the manufacture of the thermal transfer ribbon. It is also preferable that the substrate is optically transparent for the wavelength of light used to generate images. The substrate should also be neutral to electrostatic charges, but also an electrical insulator.

The substrate layer is from 4 $\mu$m to 50 $\mu$m thick. The substrate layer is preferably from 6 $\mu$m to 12 $\mu$m. The optimum thickness is about 7.5 $\mu$m. The parameters which determine the thickness of the substrate are essentially the optical transparency, the mechanical strength, the thermal conductivity, the thermal stability and the dimension stability at higher temperature. A compromise has to be made when considering these parameters. The optical transparency increases and heat transfer properties improve with a decreasing thickness. In contrast, the mechanical strength and thermal stability improve with increased thickness of the substrate layer.

Furthermore, the thickness of the substrate layer must be sufficiently high for a laser having a power of 300 mJ to effect the required heat in the donor layer for the thermal transfer mass.

In addition to thickness, breaking tensile strength also plays a role. The tensile strength at break should be, especially in the machine direction, 200N/mm$^2$, preferably 250N/mm$^2$ and more preferably 270N/mm$^2$. In the transverse direction the tensile strength at break should be:>180N/mm$^2$ preferably>220 N/mm$^2$ and more preferably, 270N/mm$^2$. The tensile strength is essentially defined by the mechanical strain exerted by the conveyor station, and depending on the width of the ribbon, by the local thermal effect.

Regarding the accuracy of imaging on the printing form cylinder, form stability of the substrate layer under a thermal stress is of particular importance. At a thermal stress of 150° C. the thermal shrinking should be less than 8% preferably less than 6.5% and more preferably less than 5%. The thermal dimension stability is required particularly for the following processes:

a) preparation, storage and shipping, b) adhesion of the donor layer to the substrate layer, if the thermal expansion coefficients and thickness of the layers between them are different, and c) the multiple use of the ribbon and the necessary spatial accuracy, which means the position of several closely arranged writing tracks whereby the writing track is necessary for the image transfer. The thermal stability of the substrate ensures the dimension stability even after transfer processes have already been performed.

The substrate should be a resin having the above-mentioned mechanical properties at a working temperature of 150° C. or more. In particular, optically clear, heat resistant and tough resins should be considered. Polypropylene and PVC-P are suitable. However, preferred resins are polyesters, polyarylether-etherketones (PEEK), polyphenylenether (PPE) and/or polycarbonates. More preferred are polyesters, such as polyesters derived from dicarboxylic acids and diols and/or hydroxycarboxylic acids or the corresponding lactones, such as polyetheyleneterephthalate (PET), polybutyleneterephthalate (PBT), poly-1,4-dimethylolcyclohexanterephthalate and polyhydroxybezoate as well as block copolyether ester, derived from polyether with terminal hydroxyl groups and also polyester modified with polycarbonates. Polyethylenenaphthalenedicarboxylates are also suitable. Commercially available PET products include Hostaphan® and Mylar®.

The resin of the substrate layer should preferably contain no softening agent. As a rule, softening agents are of a low molecular weight and therefore may evaporate during the conversion of laser light energy to heat energy. This process may lead to a so-called plasma effect. Generated plasma can reflect the incident laser beam, such that the heat which is required for softening and ejecting of particles from the donor layer cannot be achieved. Softening agents which do not induce a plasma effect when a laser having a power of 300 mJ is used are tolerable. The same applies to concentrations of common softeners.

With respect to the optical transmission of the resin used for the substrate layer, an optical transmission is desired which should be as high as possible. As a rule, the optical transmission is determined by the thickness of the ribbon and by the selection of the materials. Moreover, the optical transmission is dependent on the wavelength. Typically, the range of wavelength for IR-semiconductor lasers is from 700 to 1600 nm. Preferred are ranges from 800 nm to 900 nm, in particular from 850 to 820 nm on the one hand, and 1000 nm to 1200 nm or more particularly 1070 nm to 1030 nm on the other hand. A wavelength of about 1064 nm is required for a Nd:YAG laser. A transmission of the substrate layer of >70% of IR light in the range of wavelength from 700 nm to 1600 nm, preferably>85% is desired. Particularly preferred is>85 % transmission of IR light in the range of wavelength from 800 nm to 1100 nm. The laser used in the present invention may be a dot-like laser. However, an IR semiconductor laser diode array is more preferred.

As mentioned above, the substrate must be chemically inert. This applies in particular to chemicals used during the process of preparation of the thermal transfer ribbon, in particular organic solvents, especially ketones, aliphatic and cycloaliphatic hydrocarbons as well as acids and bases.

If a sheet is used in the form of a ribbon the width of the ribbon is 3 mm to 50 mm, preferably 8 mm to 30 and most preferably 10 to 15 mm.

The Heat Sensitive and/or Laser Light Sensitive Substance

The laser beam having penetrated the substrate layer strikes the donor layer, i.e. the layer of thermal transferable matter. At the interface between the substrate layer and the donor layer applied thereon, light energy is to be converted into heat energy in the shortest possible period of time. In order to achieve this aim it is necessary that the transferred polymer includes an additive promoting this process. In particular, these are substances which are capable of absorbing the energy of the light radiation, especially in the above mentioned ranges of wavelength, and simultaneously being capable of converting the absorbed radiation energy to heat energy. These substances may be organic dyes or organic coloring agents or pigments, provided that they do not decompose during the conversion of light energy to heat energy. Examples of particularly stable organic dyes (dystuffs) or pigments are benzothiazoles, quinolines, cyanine dyes or pigments, perylene dyes or pigments, polymethine dyes or pigments, such as oxonole dyes or pigments and merocyanine dyes and pigments. Commercially available organic dyes or pigments include KF 805 PINA from Riedl de Haen (a benzothiazole compound), KF 810 PINA from Riedl de Haen (a chinoline compound), ADS840MI, ADS840MT, ADS840AT, ADS890MC, ADS956BI, ADS800WS, ADS960HO from American Dye Source Inc., 3,3'-diethylthiatricarbocyanine-p-toluene sulphonate (a cyanine dye compound), perylene-3, 4, 8, 10-tetracarboxylic acid anhydride (a perylene compound) as well as Epolite V-63 and Epolite III-178 from Epolin Inc. Newmark. The organic dyestuffs or pigments are used in an amount of from 5 to 40 weight percent, in particular 10 to 30 weight percent of the dry matter of the donor layer. These dyes and/or pigments may be used alone or in combination in order to shift the maximum of absorption into the range of wavelength of the lasers used.

Besides organic dystuffs or organic coloring agents, inorganic substances are of interest, in particular those which do not decompose during the conversion of light energy into heat energy. Such substances include for example, titanium dioxide, aluminum oxide, further metal oxides and inorganic dye pigments. In addition, Magnetite $Fe_3O_4$; spinel black: $Cu(Cr,Fe)_2O_4$, $Co(Cr,Fe)_2O_4$; and/or manganese ferrites: $MnFe_2O_4$ may be used. These substances are used in an amount up to 20 weight percent.

Carbon black plays a particular role among substances which are capable of effectively converting light energy to heat energy. Carbon black may be favorably influenced by its process of preparation. In particular, finely distributed carbon black having an average particle size from 10 nm to 50 nm, in particular from 13 nm to 30 nm, and/or having a black value according to DIN 55979 from 200 to 290, in particular 250, may be optimally used. Carbon black substances are used in an amount up to 30 weight percent, in particular 20 weight percent. The above mentioned substances, namely organic dyes or pigments, inorganic substances which do not decompose during the conversion of light energy to heat energy and carbon black may be used alone or in combination. The amount of the heat sensitive and/or laser light sensitive substance is dependent on its capacity to convert light energy into sufficient heat energy for effective transfer of a thermal transferable matter on the substrate layer.

The Polymer of the Donor Layer

Typically, the polymer of the donor layer undergoes the following process steps. First, it softens under the influence of the laser beam. Next, it develops the required gas pressure for projecting a resin particle at the interface of the substrate layer. Finally, it transfers a semisolid plug to the printing form cylinder. Due to its hydrophilic groups the transferred resin adheres to the metal body on the hydrophilic surface of the printing form cylinder. Finally, the polymer of the prepared printing form cylinder must first undergo a fixation step by heating and than a hydrophilization step. During this step the free metal areas of the printing form cylinder are hydrophilized and the resin areas of the printing form cylinder are provided with a profile. Furthermore, the resin on the printing form cylinder should absorb printing ink and should have as long a life time as possible. The printing process can now be performed in a simple manner.

It must also be possible to remove the resin by an aqueous nontoxic solution to wash away the transferred polymer from the printing form cylinder so the form cylinder will be available for the next operation within a short time period. Therefore, the following are preferred requirements for the polymer. The polymers are soluble in an aqueous solution, but not soluble in the damping water which is normally used in an offset printing operation when paper is used as a substrate. The best mode to achieve this aim is rendering the polymer-which is normally insoluble in water-water soluble at a particular pH value, that is different from the pH value of the damping water. Preferred is the alkaline range with a pH value of more than 10, preferably 10.5, in particular more than 11.

In order to release the polymer from the substrate layer 1 the molecular weight of the polymer should preferably not exceed 20,000. On the other hand, the molecular weight should preferably not be less than 1,000; otherwise sufficient water resistance can not be achieved. Preferably the range is between 1,000 and 15,000, especially between 1,000 and 10,000.

The polymers must adsorb the printing ink. The printing ink should have a surface tension on the polymer from 10 mN/m to 50 mN/m in particular from 23 mN/m to 40 mN/m, more preferred is the range of 28 mN/m to 32 mN/m. The measurement of the contact angle is performed with 3+n test solutions according to the Wendt, Own and Rabel method.

Preferably the polymer has acidic groups in order to sufficiently adhere the transferred polymer to the hydrophilic printing form cylinder. These groups may be selected from —COOH, —$SO_3H$, —$OSO_3H$ and —$OPO_3H_2$ as well as the optionally alkyl or aryl substituted amides thereof. The alkyl group may have 1 to 6, preferably 1 to 4, carbon atoms, the aryl group may have 6 to 10, preferably 6 carbon atoms. Additionally, the polymer preferably includes an aromatic group. Preferred are phenyl groups. Preferably the polymer is derived from the polymerization of α, β-unsaturated carboxylic acid, sulphonic acid, sulfuric acid and phosphoric acid, from the esters thereof or from the above defined amides thereof, styrene as well as derivatives thereof and optionally α, β-unsaturated carboxylic esters. The selection of the acidic monomers as well as the aromatic vinylic monomers should be carried out in such a manner that the polymer has a glass transition temperature $T_g$ from 30° C. to 100° C., in particular 30° C. and 90° C. and preferably 55° C. and 65° C. The polymer preferably has a ceiling temperature in the range of the melting point, wherein the melting range is from 80 to 150° C., in particular from 90° to 140° C., preferably from 105° C. to 115° C., ideally at 110° C. Copolymers having substantial amounts of an—methyl styrene are less advantageous.

Suitable polymers are disclosed in U.S. Pat. No. 4,013,607, U.S. Pat. No. 4,414,370 as well as U.S. Pat. No. 4,529,787. The resins disclosed therein, for example, may be substantially dissolved, if a sufficient part, for instance 80% to 90% of these groups is neutralized by an aqueous solution of basic substances, such as borax, amines, ammonia hydroxide, NaOH and/or KOH. A styrene/acrylic acid resin, having an acid number of about 190, would contain not less than 0.0034 equivalents of —COOH group per gram resin and would essentially be dissolved completely if a minimum amount of about 80% to 90% of the —COOH groups are neutralized by an aqueous alkaline solution. The acid number may lie in the range of from 120 to 550, preferably from 150 to 300 and more preferably from 150 to 250. The following constituents of monomers are preferred: styrene/acrylic acid, styrene/maleic acid anhydride, methyl methacrylate/butyl acrylate/metharylic acid, α-methyl styrene/styrene/ethyl acrylate/acrylic acid, styrene/butyl acrylate/acrylic acid, styrene/methyl acrylate/butyl acrylate/ methacrylic acid. For example, an alkaline soluble resin of 68% styrene/32% acrylic acid, with a molecular weight of 500–1000 may be used. Other resins have an acid number of about 200 and a molecular weight of about 1400. Typically, styrene (α-methyl styrene)/acrylic acid (acrylate) resins have a number average molecular weight 2500 to 4500 and a weight average molecular weight from 6500 to 9500. The acid number lies in the range of 170 to 200. Exemplary polymers have 60–80 weight % of aromatic monoalkenyl monomers and 20 to 40 weight % of (meth) acrylic acid monomers and optionally 0 to 20 weight % of an acrylic monomer having no carboxylic group. Mixtures of 10:1 to 1:2 or 1:1, preferably 8:1 to 1:2, e.g. 2:1 to 1:2 styrene/α-methyl styrene may be used. However, copolymers containing substantial portions of α-methyl styrene are less preferred.

The thermal transfer ribbon used for the present process has a coating rate in the range of from 0.8 $g/m^2$ to 5 $g/m^2$+/−0.2 and in particular this range is from 1.6 $g/m^2$ to 2.0 $g/m^2$.

The Wetting Aid

The wetting aid has numerous functions. After transfer the wetting aid is still present at the interface between the metal surface and the transferred polymer such that adhesion is enhanced. Finally, it flattens the surface of the resin during the fixing stage, i.e. when post heating the transferred polymers, so that the structure of the image dots is improved. The wetting aid is selected from solvents such as alcohols, ketones, esters of phosphoric acids, glycol ether and anionic surfactants, in particular alcohols and ketones, preferred are ketones, more preferred methyl ethyl ketone. Commercial products of the above mentioned solvents are DEGDEE or DEGBBE from BASF as representatives of glycol ether and aryl alkyl sulphonic acids as representatives of the anionic surfactants or aliphatic esters of orthophosphoric acid, such as Etingal. Preferably, the solvents serving as a wetting aid are derived from the preparation of the thermal transfer ribbon.

Wetting aids may be incorporated in minute amounts (e.g. 0.05–8 weight %, preferably 0.5 to 5 weight %, based on the dry weight of the donor layer) by the preparation process itself. A further advantage of using a wetting aid is an intrinsic temperature control during the transfer process and during the thermal post-treatment. For both of these processes a maximum temperature for the required time frame is defined by the properties of boiling point, boiling range, evaporation enthalpy and heat capacity. Overheating of the transferred polymer may be controlled both by the external regulation of the heat sources and the composition of the polymer itself. Thus a high level of safety within the process operation is achieved.

The Process

The thermal transfer ribbon is prepared in a known manner. In particular, heat sensitive or laser light sensitive substances, the polymer, an optional wetting aid as well as a solvent—wherein the latter may be identical to each other—are thoroughly and homogeneously mixed. Then the resulting composition is coated with a Meyer bar or in accord with a gravure process. The dry thickness of the transfer layer is 0.5 to 5 μm, in particular 0.8 to 4 μm, preferably 1 to 3 μm and even more preferred 1.5 to 2.5 μm. After the evaporation of the solvents, the ribbon is wound up on a reel and then it is inserted into a ribbon station.

The Function of the Thermal Transfer Sheet of the Present Invention

The unit for transferring an image dot (i.e. a dot-like laser or a semiconductor diodes array) receives the data for imaging the printing form cylinder from a data processing unit. The thermal transfer sheet is moved by means of a ribbon station in relation to a printing form cylinder which in turn rotates independently during the transfer process. This relative rate and the chronological sequence of data control the imaging on the printing form cylinder. The irradiated light energy is converted to heat energy which causes a particularly high temperature increase at the interface between the substrate layer and the donor layer. By means of this rise in temperature, gases are generated at the above-mentioned interface which in turn project the softened material of the donor layer towards the metal of the printing form cylinder. During printing, the substance parts of the transferred materials define the ink adsorbing areas on the surface of the printing form cylinder based on their oleophilic property.

EXAMPLE

The above mentioned invention is illustrated by the following example in more detail. Percent, proportion and parts are based on weight unless otherwise indicated.

Measuring Methods a) The behavior of a donor layer polymer in an aqueous alkaline solution is characterized by the following measuring method:

One (1) g of the polymer is dissolved in an aqueous alkaline solution. The amounts of alkaline solution given in the below table are necessary:

| | alkaline solution in g needed for complete dissolution | pH value |
|---|---|---|
| polymer in 0.5 mol/L KOH | 10 | 13 |
| polymer in 0.1 mol/L NaOH | 50 | 11 |
| Polymer in 0.3 mol/L NaOH | 20 | 13 |

In the above table the polymer J682 from Johnson S. A. Polymer has been used.

b) The measurement of the contact angle has been performed with 3+n test solutions. The evaluation has been carried out in accordance with Wendt, Own and Rabel. The static surface tension is obtained.

c) The measurement of the glass transient temperature, of the melting range and the determination of the ceiling temperature have been performed by means of a differential scanning calorimeter (DSC) from Mettler Toledo, DSC 30/TSC IOA/TC 15 with a 150 μl aluminium cup containing 20 to 30 mg polymer. A temperature rate of 10–20° C./min has been set. The following temperature program has been used: begin at least 70 degrees below the expected Tg; end at about 50 degrees above the expected Tg or at 180° C. if necessary to avoid decomposition.

Example 1

A polyethyleneterephthalate film (PET) Hostaphan® from Hoechst that is 7.5 μm thick is coated by means of a Meyer bar with a formulation of the following composition to obtain a dried layer weighing 1.8 $g/m^2$.

Twenty percent (20%) carbon black having a "black value" according to DIN 55797 of 250 and 80% polymer J682 from Johnson S. A. Polymer and methyl ethyl ketone (MEK) in a sufficient amount for forming a coatable formulation are admixed. The paste is coated with a Meyer bar onto the polyester film. After the coating step, the coated film is dried. In the case of a ribbon having a width of e.g. 12 mm, the ribbon is wound up a heel and then the heel is inserted into the ribbon station of a printing device, for example as described in EP-B-0 698 488. The back of the ribbon is irradiated by using an IR laser semiconductor array. During this process several resin particles are transferred image-wise to the printing form cylinder. The resulting printing form cylinder is capable of printing 20,000 sheets.

The invention is not limited by the embodiments described above which are presented as examples only but can be modified in various ways within the scope of protection defined by the appended patent claims.

We claim:

1. A thermal transfer sheet, comprising:

a substrate layer including a first polymer having mechanical stability at temperatures greater than 150 degrees C. and light transmission of at least 70% for wavelengths of from about 700 nm to about 1600 nm, wherein the substrate layer is from about 4 microns thick to about 50 microns thick, having tensile strength at break in a machine direction of greater than 270 $N/mm^2$, tensile strength at break in a transverse direction of greater than 180 $N/mm^2$ and thermal shrinkage of less than 5% at 150 degrees C.; and a donor layer arranged on the substrate layer and including an additive capable of converting incident laser light energy into heat energy and a second polymer having at least one of acidic groups and amide groups;

wherein said additive is at least one of the group consisting of an organic dye having a maximum absorption of light from wavelengths of 700 nm to 1600 nm and a heat resistance of greater than 150 degrees C.; an organic coloring agent having a maximum absorption of light from wavelengths of 700 nm to 1600 nm and a heat resistance of greater than 150 degrees C.; an inorganic substance capable of converting light energy into heat energy without being decomposed; and a carbon species;

wherein said second polymer dissolves in water at a pH of at least 10, has an average molecular weight of 1000 to 20,000 and has a surface tension of from 20 mN/m to about 50 mN/m as determined by measurement of a contact angle; and wherein said acidic groups are at least one of the group consisting of —COOH, $SO_3H$, —$OSO_3H$, and —$OPO_3H_2$.

2. The thermal transfer sheet according to claim 1, further comprising a wetting aid in the donor layer, said wetting aid comprising an organic solvent which can dissolve said second polymer.

3. The thermal transfer sheet according to claim 2, wherein the organic solvent is a ketone.

4. The thermal transfer sheet according to claim 3, wherein the ketone is methyl ethyl ketone.

5. The thermal transfer sheet according to claim 3, wherein the solvent is present in an amount sufficient to achieve an intrinsic temperature control by evaporation of the solvent during a fixing step for transferring the second polymer to a printing form.

6. The thermal transfer sheet according to claim 1, wherein the first polymer is at least one of the group consisting of a polyester, a polyarylether-etherketone, a polyphenylene ether and a polycarbonate.

7. The thermal transfer sheet according to claim 6, wherein the first polymer is at least one polyester selected from the group consisting of:

a polyester derived from at least one of dicarboxylic acids and diols, hydroxycarboxylic acids and corresponding lactones;

a block copolyether ester derived from polyethers having terminal hydroxyl groups; and a polyester modified by polycarbonates.

8. The thermal transfer sheet according to claim 7, wherein the polyester is at least one of the group consisting of: polyethylene terephthalate polybutyleneterephthalate, poly-1,4-dimethylolcyclohexanterephthalate, polyhydroxybenzoate and a polyethylenenaphthalenedicarboxylate.

9. The thermal transfer sheet according to claim 8, wherein the polyester is polyethylene terephthalate.

10. The thermal transfer sheet according to claim 1, wherein the additive is at least one of a heat stable organic dye and heat stable organic pigment selected from the group consisting of benzothiazoles, quinolines, cyanine dyes, cyanine pigments, perylene dyes, perylene pigments, polymethine dyes and polymethine pigments.

11. The thermal transfer sheet according to claim 10, wherein the additive is at least one of the group consisting of oxonole dyes, oxonole pigments, merocyanine dyes and merocyanine pigments.

12. The thermal transfer sheet according to claim 1, wherein the additive is at least one of the group consisting of a titanium dioxide, an aluminum oxide, a magnetite, a spinel black, $Cu(Cr,Fe)_2O_4$, $Co(Cr,Fe)_2O_4$ and a manganese ferrite.

13. The thermal transfer sheet according to claim 1, wherein the carbon species is a finely divide carbon black having a particle size of from about 5 nm to about 100 nm.

14. The thermal transfer sheet according to claim 1, wherein the carbon species is a carbon black having a DIN 55979 black value of from 200 to 290.

15. The thermal transfer sheet according to claim 1, wherein the amide groups are substituted by at least one of alkyl groups having from 1 to 6 carbon atoms and aryl groups having from 6 to 10 carbon atoms.

16. The thermal transfer sheet according to claim 15, wherein the alkyl group has from 1 to 4 carbon atoms and the aryl group has 6 carbon atoms.

17. The thermal transfer sheet according to claim 1, wherein the second polymer has a glass transient temperature of from 30 degrees C. to 100 degrees C.

18. The thermal transfer sheet according to claim 1, wherein the second polymer has a ceiling temperature in the melting range of from 80 degrees C. to 150 degrees C.

19. The thermal transfer sheet according to claim 1, wherein the thermal transfer sheet is a thermal transfer ribbon.

20. The thermal transfer sheet of claim 1 wherein said second polymer contains acidic groups.

21. The thermal transfer sheet of claim 1 wherein said second polymer contains amide groups.

* * * * *